US009826330B2

(12) United States Patent
Shintani et al.

(10) Patent No.: US 9,826,330 B2
(45) Date of Patent: Nov. 21, 2017

(54) GIMBAL-MOUNTED LINEAR ULTRASONIC SPEAKER ASSEMBLY

(71) Applicant: SONY CORPORATION, Tokyo (JP)

(72) Inventors: Peter Shintani, San Diego, CA (US); Gregory Carlsson, Santee, CA (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/068,806

(22) Filed: Mar. 14, 2016

(65) Prior Publication Data

US 2017/0265014 A1 Sep. 14, 2017

(51) Int. Cl.

| | |
|---|---|
| ***H04R 5/02*** | (2006.01) |
| ***H04S 7/00*** | (2006.01) |
| ***H04R 3/12*** | (2006.01) |

(52) U.S. Cl.

CPC ..... *H04S 7/302* (2013.01); *H04R 3/12* (2013.01); *H04R 2201/025* (2013.01); *H04R 2201/403* (2013.01); *H04S 2400/11* (2013.01)

(58) Field of Classification Search

CPC ..... H04R 1/026; H04R 1/323; H04R 1/345; H04R 9/06; G10K 11/1788; G10K 2210/3215; H04S 7/303

USPC ..... 381/59, 87, 335–336

See application file for complete search history.

(56) References Cited

U.S. PATENT DOCUMENTS

| | | | |
|---|---|---|---|
| 4,332,979 | A | 6/1982 | Fischer |
| 6,008,777 | A | 12/1999 | Yiu |
| 6,091,826 | A | 7/2000 | Laitinen et al. |
| 6,128,318 | A | 10/2000 | Sato |
| 6,239,348 | B1 | 5/2001 | Metcalf |
| 6,317,503 | B1 | 11/2001 | Mercs et al. |
| 6,329,908 | B1 | 12/2001 | Frecska |
| 6,611,678 | B1 | 8/2003 | Zweig et al. |
| 6,741,708 | B1 | 5/2004 | Nakatsugawa |
| 7,007,106 | B1 | 2/2006 | Flood et al. |
| 7,085,387 | B1 | 8/2006 | Metcalf |
| 7,146,011 | B2 | 12/2006 | Yang et al. |
| 7,191,023 | B2 | 3/2007 | Williams |

(Continued)

FOREIGN PATENT DOCUMENTS

| | | | |
|---|---|---|---|
| EP | 2346028 | A1 | 7/2011 |
| JP | 2005080227 | A | 3/2005 |

(Continued)

OTHER PUBLICATIONS

James R. Milne, Gregory Carlsson, "Centralized Wireless Speaker System", related U.S. Appl. No. 15/019,111, Non-Final Office Action dated Jan. 20, 2017.

(Continued)

*Primary Examiner* — George Monikang

(74) *Attorney, Agent, or Firm* — John L. Rogitz

(57) ABSTRACT

Audio spatial effects are provided using a gimbal-mounted ultrasonic speaker array in which a vertical line of ultrasonic speakers are provided on a speaker mount and are angled to direct sound at respective different elevation angles. The speaker mount can be rotated by a gimbal. In this way, the azimuth angle of the linear array is established in response to a control signal from, e.g., a game console or video player, with elevational angle of the desired sound beam being established by selecting one or more of the speakers in the linear array with the appropriate elevation angle.

20 Claims, 5 Drawing Sheets

(56) References Cited

U.S. PATENT DOCUMENTS 7,483,538 B2 1/2009 McCarty et al.
7,483,958 B1 1/2009 Elabbady et al.
7,492,913 B2 2/2009 Connor et al.
7,689,613 B2 3/2010 Candelore
7,760,891 B2 7/2010 Biegelsen
7,792,311 B1 9/2010 Holmgren et al.
7,801,315 B2 9/2010 Watanabe et al.
7,822,835 B2 10/2010 Atkinson et al.
7,853,022 B2 12/2010 Thompson et al.
8,068,095 B2 11/2011 Pryor
8,077,873 B2 12/2011 Shridhar et al.
8,079,055 B2 12/2011 Hardacker et al.
8,179,755 B2 5/2012 Harris
8,199,941 B2 6/2012 Hudson et al.
8,296,808 B2 10/2012 Hardacker et al.
8,320,674 B2 11/2012 Guillou et al.
8,345,883 B2 1/2013 Takumai et al.
8,436,758 B2 5/2013 McLaughlin et al.
8,437,432 B2 5/2013 McLaughlin et al.
8,438,589 B2 5/2013 Candelore
8,509,463 B2 8/2013 Goh et al.
8,553,898 B2 10/2013 Raftery
8,605,921 B2 12/2013 Hesdahl
8,614,668 B2 12/2013 Pryor
8,621,498 B2 12/2013 Candelore
8,629,942 B2 1/2014 Candelore
8,677,224 B2 3/2014 McLaughlin et al.
8,760,334 B2 6/2014 McLaughlin et al.
8,811,630 B2 8/2014 Burlingame
9,054,790 B2 6/2015 McLaughlin et al.
9,161,111 B2 10/2015 Yuan et al.
9,282,196 B1 3/2016 Norris et al.
9,288,597 B2 3/2016 Carlsson et al.
9,300,419 B2 3/2016 Knowles
9,323,335 B2 4/2016 Williamson et al.
9,369,801 B2 6/2016 Carlsson et al.
9,402,145 B2 7/2016 Carlsson et al.
9,426,551 B2 8/2016 Carlsson et al.
9,485,556 B1 11/2016 List
9,560,449 B2 1/2017 Carlsson et al.
9,693,168 B1 6/2017 Carlsson et al.
9,693,169 B1 6/2017 Carlsson et al.
9,699,579 B2 7/2017 Carlsson et al.
2001/0037499 A1 11/2001 Turock et al.
2001/0055397 A1 12/2001 Norris et al.
2002/0054206 A1 5/2002 Allen
2002/0122137 A1 9/2002 Chen et al.
2002/0136414 A1 9/2002 Jordan et al.
2003/0046685 A1 3/2003 Srinivasan et al.
2003/0099212 A1 5/2003 Anjum et al.
2003/0107677 A1 6/2003 Lu et al.
2003/0210337 A1 11/2003 Hall
2004/0030425 A1 2/2004 Yeakel et al.
2004/0068752 A1 4/2004 Parker
2004/0196140 A1 10/2004 Sid
2004/0208324 A1 10/2004 Cheung et al.
2004/0264704 A1 12/2004 Huin et al.
2005/0024324 A1 2/2005 Tomasi et al.
2005/0125820 A1 6/2005 Nelson et al.
2005/0177256 A1 8/2005 Shintani et al.
2006/0106620 A1 5/2006 Thompson et al.
2006/0126878 A1* 6/2006 Takumai ..... H04R 3/12 381/335
2006/0195866 A1 8/2006 Thukral
2006/0227980 A1 10/2006 Barger
2006/0285697 A1 12/2006 Nishikawa et al.
2007/0183618 A1 8/2007 Ishii et al.
2007/0211022 A1 9/2007 Boillot
2007/0226530 A1 9/2007 Celinski et al.
2007/0230736 A1 10/2007 Boesen
2007/0233293 A1 10/2007 Villemoes et al.
2007/0297519 A1 12/2007 Thompson et al.
2008/0002836 A1 1/2008 Moeller et al.
2008/0025535 A1 1/2008 Rajapakse
2008/0031470 A1 2/2008 Angelhag
2008/0089268 A1 4/2008 Kinder et al.
2008/0141316 A1 6/2008 Igoe et al.
2008/0175397 A1 7/2008 Holman
2008/0207115 A1 8/2008 Lee et al.
2008/0253575 A1 10/2008 Lorgeoux et al.
2008/0259222 A1 10/2008 Hardacker et al.
2008/0279307 A1 11/2008 Gaffney et al.
2008/0279453 A1 11/2008 Candelore
2008/0304677 A1* 12/2008 Abolfathi ..... G10K 11/1788 381/71.1
2008/0313670 A1 12/2008 Ho et al.
2009/0037951 A1 2/2009 Candelore et al.
2009/0041418 A1 2/2009 Candelore et al.
2009/0060204 A1 3/2009 Reams et al.
2009/0069081 A1* 3/2009 Thorner ..... G06F 3/011 463/30
2009/0150569 A1 6/2009 Kumar et al.
2009/0172744 A1 7/2009 Rothschild
2009/0228285 A1 9/2009 Schnell et al.
2009/0252338 A1 10/2009 Koppens et al.
2009/0264114 A1 10/2009 Virolainen et al.
2009/0298420 A1 12/2009 Haartsen et al.
2009/0313675 A1 12/2009 Howarter et al.
2010/0220864 A1 9/2010 Martin
2010/0260348 A1 10/2010 Bhow et al.
2010/0272271 A1* 10/2010 Hayakawa ..... H04R 1/323 381/59
2010/0299639 A1 11/2010 Ramsay et al.
2010/0316237 A1 12/2010 Elberbaum
2011/0091055 A1 4/2011 LeBlanc
2011/0103592 A1 5/2011 Kim et al.
2011/0157467 A1 6/2011 McRae
2011/0270428 A1 11/2011 Tam
2012/0011550 A1 1/2012 Holland
2012/0014524 A1 1/2012 Vafiadis
2012/0039477 A1 2/2012 Schijers et al.
2012/0058727 A1 3/2012 Cook et al.
2012/0069868 A1 3/2012 McLaughlin et al.
2012/0070004 A1 3/2012 LaBosco et al.
2012/0087503 A1 4/2012 Watson et al.
2012/0114151 A1 5/2012 Nguyen et al.
2012/0117502 A1 5/2012 Nguyen et al.
2012/0120218 A1* 5/2012 Flaks ..... G10L 21/028 348/77
2012/0120874 A1 5/2012 McLaughlin et al.
2012/0148075 A1 6/2012 Goh et al.
2012/0158972 A1 6/2012 Gammill et al.
2012/0174155 A1 7/2012 Mowrey et al.
2012/0177225 A1 7/2012 Springfield et al.
2012/0207307 A1 8/2012 Engdegard et al.
2012/0220224 A1 8/2012 Walker
2012/0254931 A1 10/2012 Oztaskent et al.
2012/0291072 A1 11/2012 Maddison et al.
2012/0314872 A1 12/2012 Tan et al.
2012/0320278 A1 12/2012 Yoshitani et al.
2013/0003822 A1 1/2013 Margulis
2013/0039514 A1 2/2013 Knowles et al.
2013/0042292 A1 2/2013 Buff et al.
2013/0051572 A1 2/2013 Goh et al.
2013/0052997 A1 2/2013 Killick et al.
2013/0055323 A1 2/2013 Venkitaraman et al.
2013/0077803 A1 3/2013 Konno et al.
2013/0109371 A1 5/2013 Brogan et al.
2013/0121515 A1 5/2013 Hooley et al.
2013/0156212 A1 6/2013 Bjelosevic et al.
2013/0191753 A1 7/2013 Sugiyama et al.
2013/0205319 A1 8/2013 Sinha et al.
2013/0210353 A1 8/2013 Ling et al.
2013/0223279 A1 8/2013 Tinnakomsrisuphap et al.
2013/0223660 A1 8/2013 Olafsson et al.
2013/0229577 A1 9/2013 McRae
2013/0237156 A1 9/2013 Jung et al.
2013/0238538 A1 9/2013 Cook et al.
2013/0249791 A1 9/2013 Pryor
2013/0272527 A1 10/2013 Oomen et al.
2013/0272535 A1 10/2013 Yuan et al.
2013/0279888 A1 10/2013 Zeng et al.

(56) References Cited

U.S. PATENT DOCUMENTS

| | | | | |
|---|---|---|---|---|
| 2013/0298179 | A1 | 11/2013 | Baum et al. | |
| 2013/0305152 | A1 | 11/2013 | Griffiths et al. | |
| 2013/0309971 | A1 | 11/2013 | Kiukkonen et al. | |
| 2013/0310064 | A1 | 11/2013 | Brachet et al. | |
| 2013/0312018 | A1 | 11/2013 | Elliott et al. | |
| 2013/0317905 | A1 | 11/2013 | Warner et al. | |
| 2013/0321268 | A1 | 12/2013 | Tuck et al. | |
| 2013/0325396 | A1 | 12/2013 | Yuen et al. | |
| 2013/0325954 | A1 | 12/2013 | Cupala et al. | |
| 2013/0326552 | A1 | 12/2013 | Adams | |
| 2013/0332957 | A1 | 12/2013 | DeWeese et al. | |
| 2014/0003623 | A1 | 1/2014 | Lang | |
| 2014/0003625 | A1 | 1/2014 | Sheen et al. | |
| 2014/0004934 | A1 | 1/2014 | Peterson et al. | |
| 2014/0009476 | A1 | 1/2014 | Venkitaraman et al. | |
| 2014/0011448 | A1 | 1/2014 | Yang | |
| 2014/0026193 | A1 | 1/2014 | Saxman et al. | |
| 2014/0064492 | A1 | 3/2014 | Lakkundi et al. | |
| 2014/0219483 | A1 | 8/2014 | Hong | |
| 2014/0254811 | A1* | 9/2014 | Takeda | H04S 7/303 381/58 |
| 2014/0254829 | A1 | 9/2014 | Wang et al. | |
| 2014/0270306 | A1 | 9/2014 | Luna et al. | |
| 2014/0278438 | A1 | 9/2014 | Hart et al. | |
| 2014/0287806 | A1 | 9/2014 | Balachandreswaran | |
| 2014/0297296 | A1 | 10/2014 | Koppens et al. | |
| 2014/0323036 | A1 | 10/2014 | Daley et al. | |
| 2014/0328485 | A1 | 11/2014 | Saulters | |
| 2014/0355765 | A1 | 12/2014 | Kulavik et al. | |
| 2014/0362995 | A1 | 12/2014 | Backman et al. | |
| 2015/0078579 | A1 | 3/2015 | Lopez | |
| 2015/0078595 | A1 | 3/2015 | Shintani et al. | |
| 2015/0104026 | A1 | 4/2015 | Kappus et al. | |
| 2015/0128194 | A1 | 5/2015 | Kuang et al. | |
| 2015/0139439 | A1 | 5/2015 | Norris et al. | |
| 2015/0192241 | A1 | 7/2015 | Shannahan et al. | |
| 2015/0195649 | A1 | 7/2015 | Vogt | |
| 2015/0199122 | A1 | 7/2015 | Garmark et al. | |
| 2015/0201295 | A1 | 7/2015 | Lau et al. | |
| 2015/0208184 | A1 | 7/2015 | Tan et al. | |
| 2015/0208187 | A1 | 7/2015 | Carlsson et al. | |
| 2015/0208190 | A1 | 7/2015 | Hooks et al. | |
| 2015/0215722 | A1 | 7/2015 | Milne et al. | |
| 2015/0215723 | A1 | 7/2015 | Carlsson et al. | |
| 2015/0228262 | A1 | 8/2015 | Silfvast et al. | |
| 2015/0245157 | A1 | 8/2015 | Seefeldt | |
| 2015/0271620 | A1 | 9/2015 | Lando et al. | |
| 2015/0304789 | A1 | 10/2015 | Babayoff et al. | |
| 2015/0341737 | A1 | 11/2015 | Kallai et al. | |
| 2015/0350804 | A1 | 12/2015 | Crockett et al. | |
| 2015/0358707 | A1 | 12/2015 | Saijo et al. | |
| 2015/0358768 | A1 | 12/2015 | Luna et al. | |
| 2015/0373449 | A1 | 12/2015 | Jackson | |
| 2015/0382129 | A1 | 12/2015 | Florencio et al. | |
| 2016/0157008 | A1 | 6/2016 | Zhang et al. | |
| 2016/0171964 | A1 | 6/2016 | Kim et al. | |
| 2016/0174012 | A1 | 6/2016 | Tan et al. | |
| 2016/0195856 | A1 | 7/2016 | Spero | |
| 2016/0286330 | A1 | 9/2016 | Kofman et al. | |
| 2016/0286350 | A1 | 9/2016 | Lin et al. | |
| 2016/0350067 | A1 | 12/2016 | Sundaresan et al. | |
| 2016/0359512 | A1 | 12/2016 | Fathollahi et al. | |
| 2017/0019742 | A1 | 1/2017 | Rappoport | |
| 2017/0045941 | A1 | 2/2017 | Tokubo et al. | |
| 2017/0064457 | A1 | 3/2017 | Kupershmidt et al. | |
| 2017/0086008 | A1 | 3/2017 | Robinson | |
| 2017/0164099 | A1 | 6/2017 | Shintani et al. | |

FOREIGN PATENT DOCUMENTS

| | | | |
|---|---|---|---|
| JP | 2011004077 | A | 1/2011 |
| WO | 2009002292 | A1 | 12/2008 |
| WO | 2012164444 | A1 | 12/2012 |
| WO | 2014184353 | A1 | 11/2014 |

OTHER PUBLICATIONS

James R. Milne, Gregory Carlsson, "Centralized Wireless Speaker System", related U.S. Appl. No. 15/019,111, Applicant's response to Non-Final Office Action filed Jan. 25, 2017.

"Method and System for Discovery and Configuration of Wi-Fi Speakers", http://ip.com/IPCOM/000220175; Dec. 31, 2008.

Frieder Ganz, Payam Barnaghi, Francois Carrez, Klaus Moessner, "Context-Aware Management for Sensor Networks", University of Surrey, Guildford, UK Publication, 2011.

Robert W. Reams, "N-Channel Rendering: Workable 3-D Audio for 4kTV", AES 135, New York City, 2013.

Sokratis Kartakis, Margherita Antona, Constantine Stephandis, "Control Smart Homes Easily with Simple Touch", University of Crete, Crete, GR, 2011.

Gregory Peter Carlsson, Steven Martin Richman, James R. Milne, "Distributed Wireless Speaker System", file history of related U.S. Appl. No. 14/158,396, filed Jan. 17, 2014.

James R. Milne, Gregory Peter Carlsson, Steven Martin Richman, Frederick J. Zustak, "Audio Speaker System with Virtual Music Performance", file history of related U.S. Appl. No. 14/163,415, filed Jan. 24, 2014.

Gregory Peter Carlsson, Keith Resch, Oscar Manuel Vega, "Networked Speaker System with Follow Me", file history of related U.S. Appl. No. 14/974,413, filed Dec. 18, 2015.

James R. Milne, Gregory Carlsson, "Centralized Wireless Speaker System", file history of related U.S. Appl. No. 15/019,111, filed Feb. 9, 2016.

James R. Milne, Gregory Carlsson, "Distributed Wireless Speaker System", file history of related U.S. Appl. No. 15/044,920, filed Feb. 16, 2016.

James R. Milne, Gregory Carlsson, Steven Richman, Frederick Zustak, "Wireless Speaker System", file history of related U.S. Appl. No. 15/044,981, filed Feb. 16, 2016.

Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Final Office Action dated Feb. 27, 2017.

Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Applicant's response to Final Office Action filed Mar. 6, 2017.

James R. Milne, Gregory Carlsson, "Distributed Wireless Speaker System", related U.S. Appl. No. 15/044,920, Final Office Action dated Mar. 2, 2017.

James R. Milne, Gregory Carlsson, "Distributed Wireless Speaker System", related U.S. Appl. No. 15/044,920, Applicant's response to Final Office Action filed Mar. 14, 2017.

"Ack Pro Mid-Sized Ball Bearing Brushless Gimbal With Turnigy 4008 Motors", Hobbyking.com, Retrieved on Nov. 27, 2015 from http://www.hobbyking/store/__51513__ACK__Pro__Mid__Sized__Ball__Bearing__Brushless__Gimbal__With__Turnigy__4008__Motors__NEX5__and__GF.html.

Patrick Lazik, Niranjini Rajagopal, Oliver Shih, Bruno Sinopoli, Anthony Rowe, "ALPS: A Bluetooth and Ultrasound Platform for Mapping and Localization", Dec. 4, 2015, Carnegie Mellon University.

Santiago Elvira, Angel De Castro, Javier Garrido, "ALO4: Angle Localization and Orientation System with Four Receivers", Jun. 27, 2014, International Journal of Advanced Robotic Systems.

Woon-Seng Gan, Ee-Leng Tan, Sen M. Kuo, "Audio Projection: Directional Sound and Its Applications in Immersive Communication", 2011, IEE Signal Processing Magazine, 28(1), 43-57.

Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", file history of related U.S. Appl. No. 14/968,349, filed Dec. 14, 2015.

Gregory Carlsson, Masaomi Nishidate, Morio Usami, Kiyoto Shibuya, Norihiro Nagai, Peter Shintani, "Ultrasonic Speaker Assembly for Audio Spatial Effect", file history of related U.S. Appl. No. 15/018,128, filed Feb. 8, 2016.

(56) References Cited

OTHER PUBLICATIONS

Gregory Carlsson, Morio Usami, Peter Shintani, "Ultrasonic Speaker Assembly With Ultrasonic Room Mapping", file history of related U.S. Appl. No. 15/072,098, filed Mar. 16, 2016.
James R. Milne, Gregory Peter Carlsson, Steven Martin Richman, Frederick J. Zustak, "Audio Speaker System With Virtual Music Performance", related U.S. Appl. No. 14/163,415, Non-Final Office Action dated Jan. 13, 2017.
James R. Milne, Gregory Peter Carlsson, Steven Martin Richman, Frederick J. Zustak, "Audio Speaker System With Virtual Music Performance", related U.S. Appl. No. 14/163,415, Applicant's response to Non-Final Office Action filed Jan. 17, 2017.
Gregory Peter Carlsson, Keith Resch, Oscar Manuel Vega, "Networked Speaker System with Follow Me", related U.S. Appl. No. 14/974,413, Applicant's response to Non-Final Office Action filed Jan. 5, 2017.
Gregory Carlsson, Morio Usami, Peter Shintani, "Ultrasonic Speaker Assembly with Ultrasonic Room Mapping", related U.S. Appl. No. 15/072,098, Applicant's response to Non-Final Office Action filed Jan. 9, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Non-Final Office Action dated Jan. 17, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Applicant's response to Non-Final Office Action filed Jan. 18, 2017.
James R. Milne, Gregory Carlsson, "Distributed Wireless Speaker System", related U.S. Appl. No. 15/044,920, Non-Final Office Action dated Jan. 13, 2017.
James R. Milne, Gregory Carlsson, "Distributed Wireless Speaker System", related U.S. Appl. No. 15/044,920, Applicant's response to Non-Final Office Action filed Jan. 17, 2017.
Gregory Peter Carlsson, Keith Resch, Oscar Manuel Vega, "Networked Speaker System With Follow Me", related U.S. Appl. No. 14/974,413, Final Office Action dated Feb. 21, 2017.
Peter Shintani, Gregory Carlsson, "Ultrasonic Speaker Assembly Using Variable Carrier Frequency to Establish Third Dimension Sound Locating", file history of related U.S. Appl. No. 15/214,748, filed Jul. 20, 2016.
Gregory Peter Carlsson, Keith Resch, Oscar Manuel Vega, "Networked Speaker System with Follow Me", related U.S. Appl. No. 14/974,413, Non-Final Office Action dated Oct. 21, 2016.
Gregory Peter Carlsson, Keith Resch, Oscar Manuel Vega, "Networked Speaker System with Follow Me", related U.S. Appl. No. 14/974,413, Applicant's response to Non-Final Office Action filed Oct. 26, 2016.
Gregory Carlsson, Morio Usami, Peter Shintani, "Ultrasonic Speaker Assembly With Ultrasonic Room Mapping", related U.S. Appl. No. 15/072,098, Non-Final Office Action dated Jan. 4, 2017.
Gregory Peter Carlsson, Keith Resch, Oscar Manuel Vega, "Networked Speaker System with Follow Me", related U.S. Appl. No. 14/974,413, Final Office Action dated Nov. 28, 2016.
James R. Milne, Gregory Carlsson, Steven Richman, Frederick Zustak, "Wireless Speaker System", related U.S. Appl. No. 15/044,981, Non-Final Office Action dated Nov. 28, 2016.
Gregory Peter Carlsson, Keith Resch, Oscar Manuel Vega, "Networked Speaker System with Follow Me", related U.S. Appl. No. 14/974,413, Applicant's response to Final Office Action filed Dec. 2, 2016.
Gregory Peter Carlsson, Keith Resch, Oscar Manuel Vega, "Networked Speaker System with Follow Me", related U.S. Appl. No. 14/974,413, Non-Final Office Action dated Dec. 21, 2016.
James R. Milne, Gregory Carlsson, Steven Richman, Frederick Zustak, "Wireless Speaker System", related U.S. Appl. No. 15/044,981, Applicant's response to Non-Final Office Action filed Dec. 14, 2016.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Non-Final Office Action dated Mar. 20, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Applicant's response to Non-Final Office Action filed Mar. 21, 2017.
Gregory Peter Carlsson, Keith Resch, Oscar Manuel Vega, "Networked Speaker System With Follow Me", related U.S. Appl. No. 14/974,413, Applicant's response to the Final Office Action filed Mar. 21, 2017.
James R. Milne, Gregory Carlsson, "Centralized Wireless Speaker System", related U.S. Appl. No. 15/019,111, Applicant's response to Non-Final Office Action filed May 11, 2017.
James R. Milne, Gregory Carlsson, Steven Richman, Frederick Zustak, "Wireless Speaker System", Applicant's response to Final Office Action filed May 10, 2017.
James R. Milne, Gregory Carlsson, "Centralized Wireless Speaker System", related U.S. Appl. No. 15/019,111, Non-Final Office Action dated Apr. 21, 2017.
James R. Milne, Gregory Peter Carlsson, Steven Martin Richman, Frederick J. Zustak, "Audio Speaker System with Virtual Music Performance", related U.S. Appl. No. 14/163,415, Final Office Action dated Mar. 29, 2017.
James R. Milne, Gregory Peter Carlsson, Steven Martin Richman, Frederick J. Zustak, "Audio Speaker System with Virtual Music Performance", related U.S. Appl. No. 14/163,415, Applicant's response to Final Office Action filed Apr. 4, 2017.
James R. Milne, Gregory Carlsson, "Centralized Wireless Speaker System", related U.S. Appl. No. 15/019,111, Final Office Action dated Mar. 31, 2017.
James R. Milne, Gregory Carlsson, "Centralized Wireless Speaker System", related U.S. Appl. No. 15/019,111, Applicant's response to Final Office Action filed Apr. 4, 2017.
James R. Milne, Gregory Carlsson, Steven Richman, Frederick Zustak, "Wireless Speaker System", related U.S. Appl. No. 15/044,981, Final Office Action dated Apr. 12, 2017.
Peter Shintani, Gregory Peter Carlsson, Morio Usami, Kiyoto Shibuya, Norihiro Nagai, "Gimbal-Mounted Ultrasonic Speaker for Audio Spatial Effect", related U.S. Appl. No. 14/968,349, Final Office Action dated May 23, 2017.
Peter Shintani, Gregory Peter Carlsson, Morio Usami, Kiyoto Shibuya, Norihiro Nagai, "Gimbal-Mounted Ultrasonic Speaker for Audio Spatial Effect", related U.S. Appl. No. 14/968,349, Applicant's response to Final Office Action filed Jun. 12, 2017.
James R. Milne, Gregory Carlsson, "Centralized Wireless Speaker System", related U.S. Appl. No. 15/019,111, Final Office Action dated Jun. 9, 2017.
James R. Milne, Gregory Carlsson, Steven Richman, Frederick Zustak, "Wireless Speaker System", related pending U.S. Appl. No. 15/044,981, non-final office action dated Jul. 28, 2017.
James R. Milne, Gregory Carlsson, Steven Richman, Frederick Zustak, "Wireless Speaker System", related pending U.S. Appl. No. 15/044,981, applicant's response to non-final office action filed Aug. 16, 2017.
James R. Milne, Gregory Peter Carlsson, Steven Martin Richman, Frederick J. Zustak, "Audio Speaker System with Virtual Music Performance", related U.S. Appl. No. 14/163,415, Non-Final Office Action dated Jul. 12, 2017.
James R. Milne, Gregory Peter Carlsson, Steven Martin Richman, Frederick J. Zustak, "Audio Speaker System with Virtual Music Performance", related U.S. Appl. No. 14/163,415, Applicant's response to Non-Final Office Action filed Jul. 17, 2017.
Peter Shintani, Gregory Carlsson, "Ultrasonic Speaker Assembly Using Variable Carrier Frequency to Establish Third Dimension Sound Locating", related U.S. Appl. No. 15/214,748, Non-Final Office Action dated Jul. 6, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Non-Final Office Action dated Sep. 14, 2017.

(56) References Cited

OTHER PUBLICATIONS

Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Applicant's response to Non-Final Office Action filed Sep. 18, 2017.

* cited by examiner

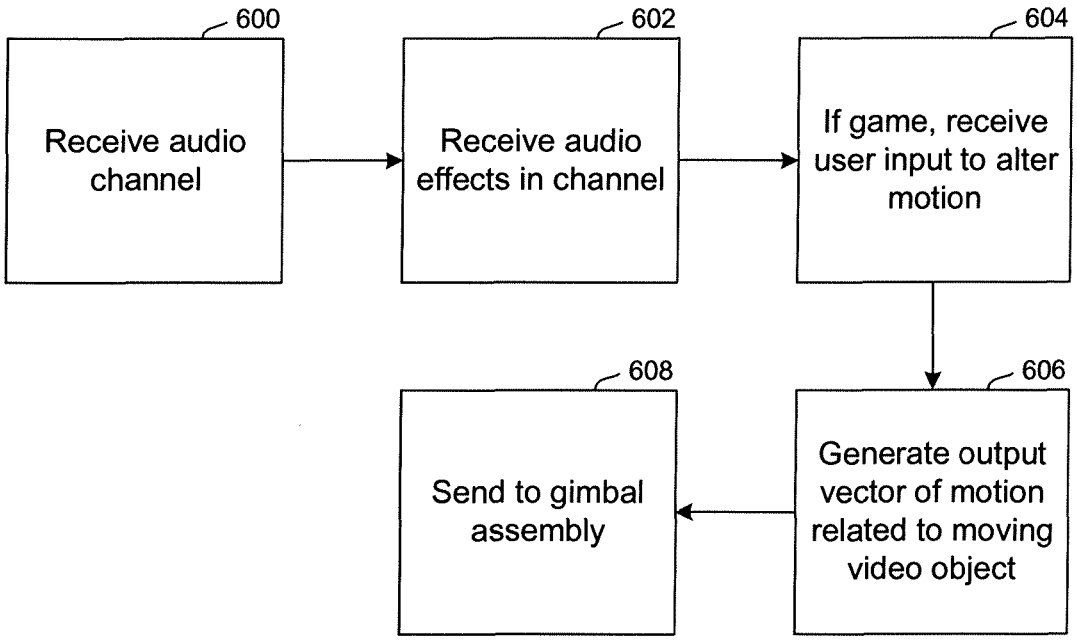
FIG. 6 (control signal source)
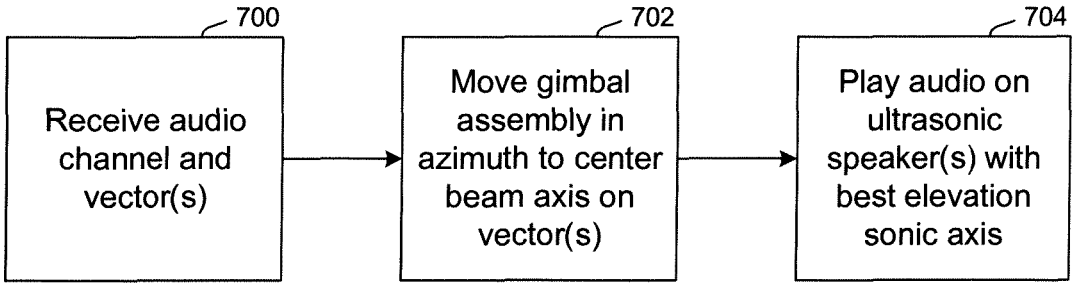
FIG. 7 (speaker assembly)

GIMBAL-MOUNTED LINEAR ULTRASONIC SPEAKER ASSEMBLY

The application relates generally to gimbal-mounted linear ultrasonic speaker assemblies.

BACKGROUND

Audio spatial effects to model the movement of a sound-emitting video object as if the object were in the space in which the video is being displayed are typically provided using multiple speakers and phased-array principles. As understood herein, such systems may not as accurately and precisely model audio spatial effects or be as compact as is possible using present principles.

SUMMARY

An apparatus includes at least one speaker mount and plural ultrasonic speakers arranged on the speaker mount in a vertical line, with each ultrasonic speaker being configured to emit sound along a respective sonic axis. A gimbal assembly is coupled to the speaker mount. At least one computer memory that is not a transitory signal includes instructions executable by at least one processor to receive a control signal, and responsive to the control signal actuate the gimbal assembly to move the speaker such that the sound axes move azimuthally.

If desired, the sonic axes may establish respective angles with respect to a vertical axis, with the angles being different from each other. In some embodiments, the instructions may be executable to, responsive to the control signal, actuate a first speaker on the speaker mount responsive to a determination that a sonic axis of the first speaker satisfies the control signal more closely than the sonic axes of speakers other than the first speaker.

The control signal can be received from a computer game console outputting a main audio channel for playing on non-ultrasonic speakers. In non-limiting implementations, responsive to the control signal, the instructions can be executable to move the speaker mount to direct sound to a location associated with a listener. In specific non-limiting embodiments the instructions can be executable to direct sound at a reflection location such, that reflected sound arrives at the location associated with the listener. The control signal may represent at least one audio effect data in a received audio channel.

In another aspect, a method includes receiving at least one control signal representing an audio effect. The method actuates a gimbal assembly to move an ultrasonic speaker mount at least in part based on an azimuthal component of the control signal. Also, the method selects one of plural speakers on the speaker mount to play the audio effect at least in part based on an elevational component of the control signal.

In another aspect, a device includes at least one computer memory that is not a transitory signal and that includes instructions executable by at least one processor to receive a control signal, and responsive to the control signal, actuate a gimbal assembly to move an ultrasonic speaker assembly azimuthally. The instructions are executable to, responsive to the control signal, select for play of demanded audio one of plural speakers on the speaker assembly.

The details of the present application, both as to its structure and operation, can best be understood in reference to the accompanying drawings, in which like reference numerals refer to like parts, and in which:

BRIEF DESCRIPTION OF THE DRAWINGS

FIGS. 6 and 7 are flow charts of example logic attendant to the system in FIG. 3;

DETAILED DESCRIPTION

Figure 1:
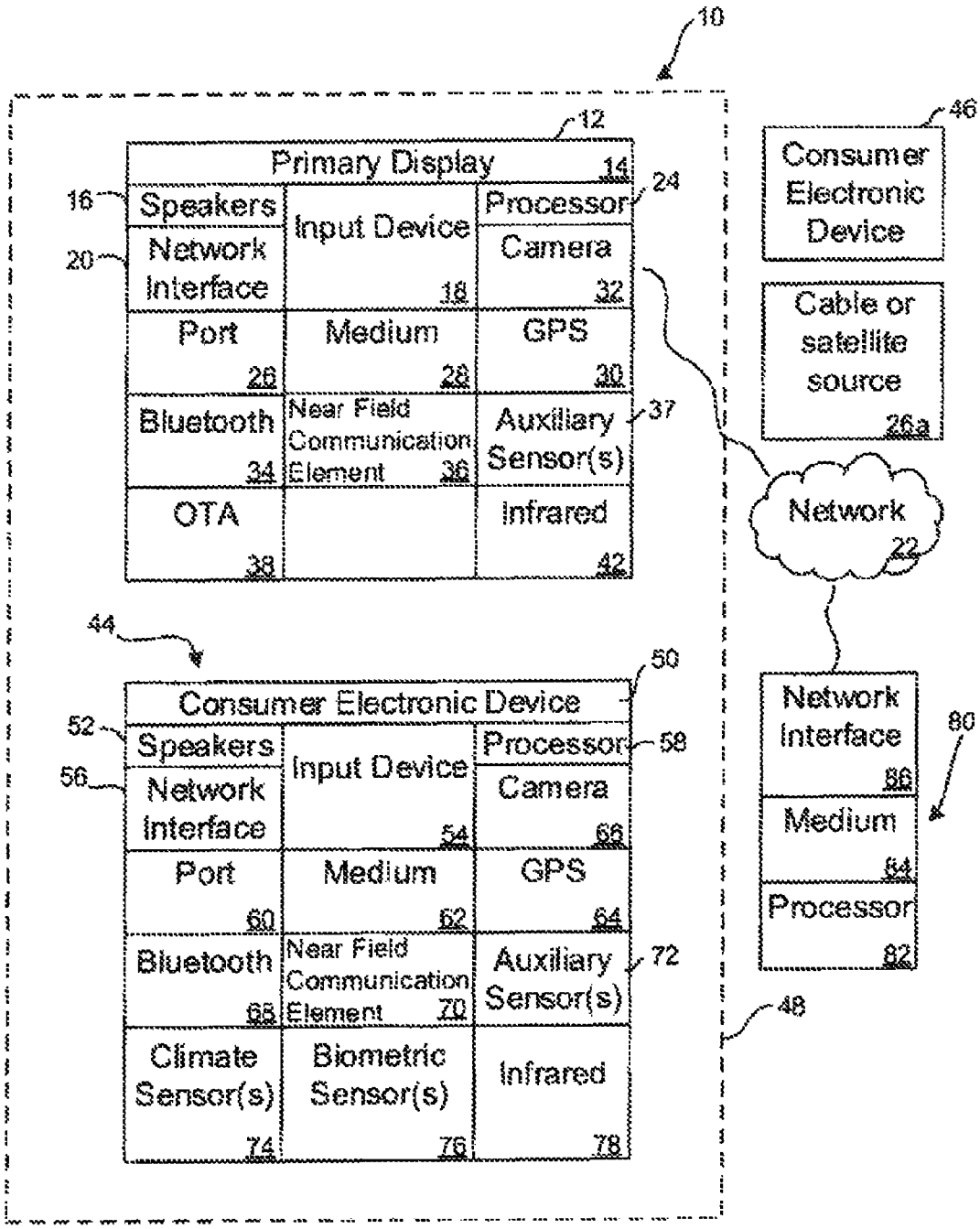
FIG. 1 is a block diagram of an example system including an example in accordance with present principles.

This disclosure relates generally to computer ecosystems including aspects of consumer electronics (CE) device networks. A system herein may include server and client components, connected over a network such that data may be exchanged between the client and server components. The client components may include one or more computing devices including portable televisions (e.g. smart TVs, Internet-enabled TVs), portable computers such as laptops and tablet computer, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers and/or gateways may include one or more processors executing instructions that configure the servers to receive and transmit data over a network such as the Internet. Or, a client and server can be connected over a local internet or a virtual private network. A server or controller may be instantiated by a game console such as a Sony Playstation (trademarked), a personal computer, etc.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires. Such connections may include wireless communication connections including infrared and radio.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example ecosystem 10 is shown, which may include one or more of the example devices mentioned above and described further below in accordance with present principles. The first of the example devices included in the system 10 is a consumer electronics (CE) device configured as an example primary display device, and in the embodiment shown is an audio video display device (AVDD) 12 such as but not limited to an Internet-enabled TV with a TV tuner (equivalently, set top box controlling a TV). However, the AVDD 12 alternatively may be an appliance or household item, e.g. computerized Internet enabled refrigerator, washer, or dryer. The AVDD 12 alternatively may also be a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, game console, etc. Regardless, it is to be understood that the AVDD 12 is configured to undertake present principles (e.g. communicate with other CE devices to undertake present principles, execute the logic described herein, and perform any other functions and/or operations described herein).

Accordingly, to undertake such principles the AVDD 12 can be established by some or all of the components shown in FIG. 1. For example, the AVDD 12 can include one or more displays 14 that may be implemented by a high definition or ultra-high definition "4K" or higher flat screen and that may be touch-enabled for receiving user input signals via touches on the display. The AVDD 12 may include one or more speakers 16 for outputting audio in accordance with present principles, and at least one additional input device 18 such as e.g. an audio receiver/microphone for e.g. entering audible commands to the AVDD 12 to control the AVDD 12. The example AVDD 12 may also include one or more network interfaces 20 for communication over at least one network 22 such as the Internet, an WAN, an LAN, etc. under control of one or more processors 24. Thus, the interface 20 may be, without limitation, a Wi-Fi transceiver, which is an example of a wireless computer network interface, such as but not limited to a mesh network transceiver. It is to be understood that the processor 24 controls the AVDD 12 to undertake present principles, including the other elements of the AVDD 12 described herein such as e.g. controlling the display 14 to present images thereon and receiving input therefrom. Furthermore, note the network, interface 20 may be, e.g., a wired or wireless modem or router, or other appropriate interface such as, e.g., a wireless telephony transceiver, or Wi-Fi transceiver as mentioned above, etc.

In addition to the foregoing, the AVDD 12 may also include one or more input ports 26 such as, e.g., a high definition multimedia interface (HDMI) port or a USB port to physically connect (e.g. using a wired connection) to another CE device and/or a headphone port to connect headphones to the AVDD 12 for presentation of audio from the AVDD 12 to a user through the headphones. For example, the input port 26 may be connected via wire or wirelessly to a cable or satellite source **26*a* of audio video content. Thus, the source 26*a* may be, e.g., a separate or integrated set top box, or a satellite receiver. Or, the source 26*a*** may be a game console or disk player containing content that might be regarded by a user as a favorite for channel assignation purposes described further below.

The AVDD 12 may further include one or more computer memories 28 such as disk-based or solid state storage that are not transitory signals, in some cases embodied in the chassis of the AVDD as standalone devices or as a personal video recording device (PVR) or video disk player either internal or external to the chassis of the AVDD for playing back AV programs or as removable memory media. Also in some embodiments, the AVDD 12 can include a position or location receiver such as but not limited to a cellphone receiver, GPS receiver and/or altimeter 30 that is configured to e.g. receive geographic position information from at least one satellite or cellphone tower and provide the information to the processor 24 and/or determine an altitude at which the AVDD 12 is disposed in conjunction with the processor 24. However, it is to be understood that that another suitable position receiver other than a cellphone receiver, GPS receiver and/or altimeter may be used in accordance with present principles to e.g. determine the location of the AVDD 12 in e.g. all three dimensions.

Continuing fee description of the AVDD 12, in some embodiments the AVDD 12 may include one or more cameras 32 that may be, e.g., a thermal imaging camera, a digital camera such as a webcam, and/or a camera integrated into the AVDD 12 and controllable by the processor 24 to gather pictures/images and/or video in accordance with present principles. Also included on the AVDD 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the AVDD 12 may include one or more auxiliary sensors 37 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), etc.) providing input to the processor 24. The AVDD 12 may include an over-the-air TV broadcast port 38 for receiving OTH TV broadcasts providing input to the processor 24. In addition to the foregoing, it is noted that the AVDD 12 may also include an infrared (IR) transmitter and/or IR receiver and/or IR transceiver 42 such as an IR data association (IRDA) device. A battery (not shown) may be provided for powering the AVDD 12.

Still referring to FIG. 1, in addition to the AVDD 12, the system 10 may include one or more other CE device types. When the system 10 is a home network, communication between components may be according to the digital living network alliance (DLNA) protocol.

In one example, a first CE device 44 may be used to control the display via commands sent through the below-described server while a second CE device 46 may include similar components as the first CE device 44 and hence will not be discussed in detail. In the example shown, only two CE devices 44, 46 are shown, it being understood that fewer or greater devices may be used.

In the example shown, to illustrate present principles all three devices 12, 44, 46 are assumed to be members of an entertainment network in, e.g., a home, or at least to be present in proximity to each other in a location such as a house. However, for present principles are not limited to a particular location, illustrated by dashed lines 48, unless explicitly claimed otherwise.

The example non-limiting first CE device 44 may be established by any one of the above-mentioned devices, for example, a portable wireless laptop computer or notebook computer or game controller, and accordingly may have one or more of the components described below. The second CE device 46 without limitation may be established by a video disk player such as a Blu-ray player, a game console, and the like. The first CE device 44 may be a remote control (RC) for, e.g., issuing AV play and pause commands to the AVDD 12, or it may be a more sophisticated device such as a tablet computer, a game controller communicating via wired or wireless link with a game console implemented by the second CE device 46 and controlling video game presentation on the AVDD 12, a personal computer, a wireless telephone, etc.

Accordingly, the first CE device 44 may include one or more displays 50 that may be touch-enabled for receiving user input signals via touches on the display. The first CE device 44 may include one or more speakers 52 for outputting audio in accordance with present principles, and at least one additional input device 54 such as e.g. an audio receiver/microphone for e.g. entering audible commands to the first CE device 44 to control the device 44. The example first CE device 44 may also include one or more network interfaces 56 for communication over the network 22 under control of one or more CE device processors 58. Thus, the interface 56 may be, without limitation, a Wi-Fi transceiver, which is an example of a wireless computer network, interface, including mesh network interfaces. It is to be understood that the processor 58 controls the first CE device 44 to undertake present principles, including the other elements of the first CE device 44 described herein such as e.g. controlling the display 50 to present images thereon and receiving input therefrom. Furthermore, note the network interface 56 may be, e.g., a wired or wireless modem or router, or other appropriate interface such as, e.g., a wireless telephony transceiver, or Wi-Fi transceiver as mentioned above, etc.

In addition to the foregoing, the first CE device 44 may also include one or more input ports 60 such, as, e.g., a HDMI port or a USB port to physically connect (e.g. using a wired connection) to another CE device and/or a headphone port to connect headphones to the first CE device 44 for presentation of audio from the first CE device 44 to a user through the headphones. The first CE device 44 may further include one or more tangible computer readable storage medium 62 such as disk-based or solid state storage. Also in some embodiments, the first CE device 44 can include a position or location receiver such as but not limited to a cellphone and/or GPS receiver and/or altimeter 64 that is configured to e.g. receive geographic position information from, at least one satellite and/or cell tower, using triangulation, and provide the information to the CE device processor 58 and/or determine an altitude at which the first CE device 44 is disposed in conjunction with the CE device processor 58. However, it is to be understood that that another suitable position receiver other than a cellphone and/or GPS receiver and/or altimeter may be used in accordance with present principles to e.g. determine the location of the first CE device 44 in e.g. all three dimensions.

Continuing the description of the first CE device 44, in some embodiments the first CE device 44 may include one or more cameras 66 that may be, e.g., a thermal imaging camera, a digital camera such as a webcam, and/or a camera integrated into the first CE device 44 and controllable by the CE device processor 58 to gather pictures/images and/or video in accordance with present principles. Also included on the first CE device 44 may be a Bluetooth transceiver 68 and other Near Field Communication (NFC) element 70 for communication wits other devices using Bluetooth and/or NFC technology, respectively. An example NFC element can be a radio frequency identification (RFID) element.

Further still, the first CE device 44 may include one or more auxiliary sensors 72 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), etc.) providing input to the CE device processor 58. The first CE device 44 may include still other sensors such as e.g. one or more climate sensors 74 (e.g. barometers, humidity sensors, wind sensors, light sensors, temperature sensors, etc.) and/or one or more biometric sensors 76 providing input to the CE device processor 58. In addition to the foregoing, it is noted that in some embodiments the first CE device 44 may also include an infrared (IR) transmitter and/or IR receiver and/or IR transceiver 42 such as an IR data association (IRDA) device. A battery (not shown) may be provided for powering the first CE device 44. The CE device 44 may communicate with the AVDD 12 through any of the above-described communication modes and related components.

The second CE device 46 may include some or all of the components shown for the CE device 44. Either one or both CE devices may be powered by one or more batteries.

Now in reference to the afore-mentioned at least one server 80, it includes at least one server processor 82, at least one tangible computer readable storage medium 84 such as disk-based or solid state storage, and at least one network interface 86 that, under control of the server processor 82, allows for communication with the other devices of FIG. 1 over the network 22, and indeed may facilitate communication between servers and client devices in accordance with present principles. Note that the network interface 86 may be, e.g., a wired or wireless modem or router, Wi-Fi transceiver, or other appropriate interface such as, e.g., a wireless telephony transceiver.

Accordingly, in some embodiments the server 80 may be an Internet server, and may include and perform "cloud" functions such that the devices of the system 10 may access a "cloud" environment via the server 80 in example embodiments. Or, the server 80 may be implemented by a game console or other computer in the same room as the other devices shown in FIG. 1 or nearby.

Figure 2:
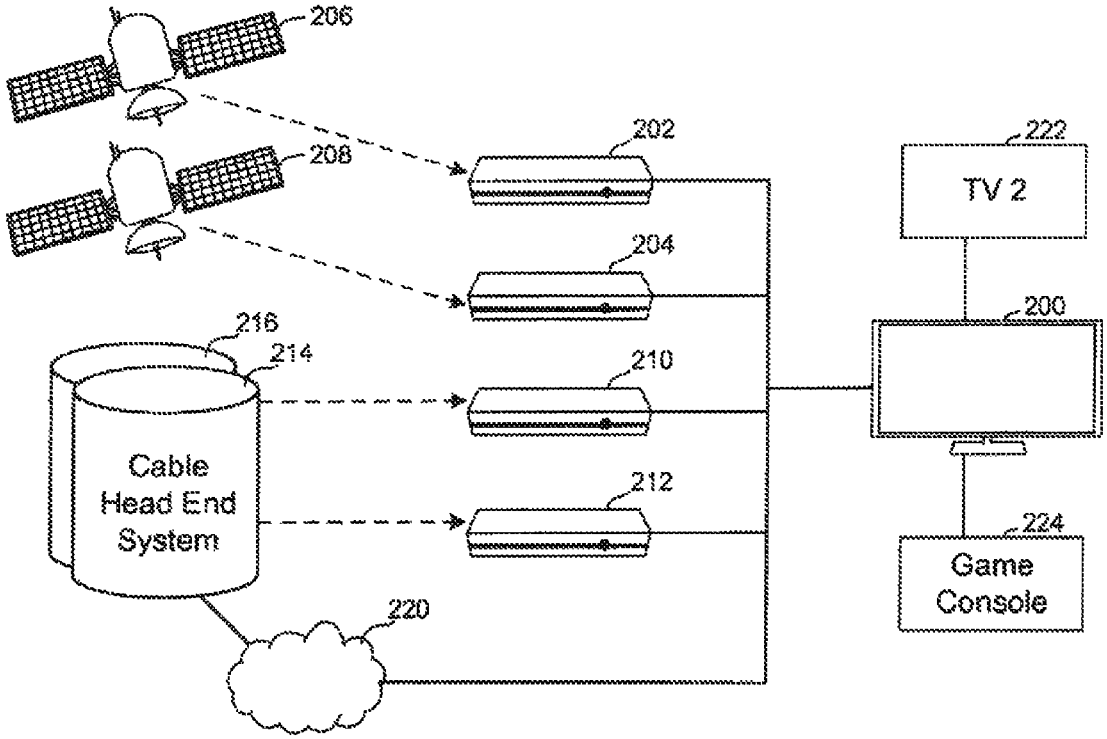
FIG. 2 is s block diagram of another system that can use fee components of FIG. 1.

Now referring to FIG. 2, an AVDD 200 that may incorporate some or all of the components of the AVDD 12 in FIG. 1 is connected to at least one gateway for receiving content, e.g., UHD content such as 4K or 8K content, from the gateway. In the example shown, the AVDD 200 is connected to first and second satellite gateways 202, 204, each of which may be configured as a satellite TV set top box for receiving satellite TV signals from respective satellite systems 206, 208 of respective satellite TV providers.

In addition or in lieu of satellite gateways, the AVDD 200 may receive content from one or more cable TV set top box-type gateways 210, 212, each of which receives content from a respective cable head end 214, 216.

Yet again, instead of set-top box like gateways, the AVDD 200 may receive content from a cloud-based gateway 220. The cloud-based gateway 220 may reside in a network interface device that is local to the AVDD 200 (e.g., a modem of the AVDD 200) or it may reside in a remote Internet server that sends Internet-sourced content to the AVDD 200. In any case, the AVDD 200 may receive multimedia content such as UHD content from the Internet through the cloud-based gateway 220. The gateways are computerized and thus may include appropriate components of any of the CE devices shown in FIG. 1.

In some embodiments, only a single set top box-type gateway may be provided using, e.g., the present assignee's remote viewing user interface (RVU) technology.

Tertiary devices may be connected, e.g., via Ethernet or universal serial bus (USB) or WiFi or other wired or wireless protocol to the AVDD 200 in a home network (that may be a mesh-type network) to receive content from the AVDD 200 according to principles herein. In the non-limiting example shown, a second TV 222 is connected to the AVDD 200 to receive content therefrom, as is a video game console 224. Additional devices may be connected to one or more tertiary devices to expand the network. The tertiary devices may include appropriate components of any of the CE devices shown in FIG. 1.

Figure 3:
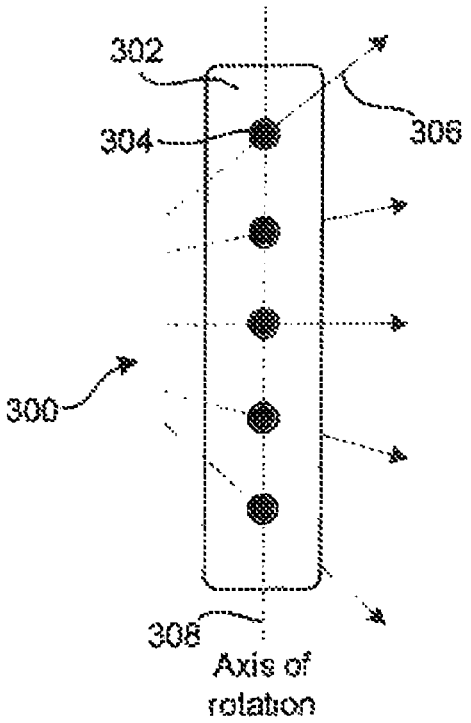
FIG. 3 is a schematic side elevational diagram of an example linear ultrasonic speaker assembly mounted on a gimbal.
Figure 4:
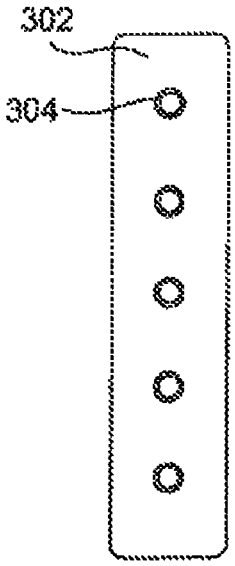
FIG. 4 is a schematic front elevational view of the assembly in FIG. 3.

FIG. 3 is a schematic side elevational view of an ultrasonic speaker assembly 300 and FIG. 4 is a schematic front view of the assembly 300, which includes an elongated vertically-oriented speaker mount 302 holding a linear array of ultrasonic speakers 304 arranged in a vertical line, one above the other as shown. While the speakers 304 are arranged in a line as best shown in FIG. 4, in other embodiments the speakers 302 may not be arranged in a single line, but are arranged at different respective elevations on the speaker mount 302. Also, while the mount 302 is preferably oriented along the vertical relative to the Earth as shown, in other embodiments the mount 302 may be tilted with respect to vertical.

Each speaker 304 is oriented on the mount 302 to emit sound along a respective sonic axis 306. When the speakers are arranged in a vertical line as shown in FIGS. 3 and 4, the sonic axes 306 all lie in the same vertical plane.

As best shown in FIG. 3, the assembly 300 achieves vertical diversity in some example embodiments by orienting the sonic axes 306 at differing angles with respect to the vertical axis 308 of the mount 302, although in other embodiments plural sonic axes may be parallel to each other. In a preferred embodiment for instance, a first sonic axis, typically that of the center-most speaker 304, may be oriented along the horizontal dimension, whereas other sonic axes may form progressively more acute angles with respect to the vertical axis 308 starting at the center speaker in the array and working up (or down) as shown in FIG. 3.

Figure 5:
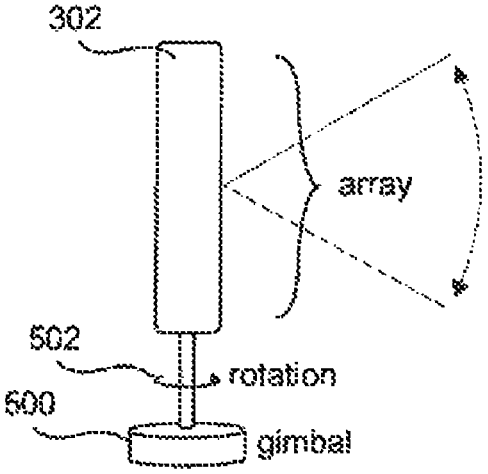
FIG. 5 shows the speaker mount of FIG. 3 coupled to a gimbal to rotate the mount.

Thus, in the assembly shown in FIGS. 3 and 4, an audio effects speaker system can generate localized sound effects within a given space, with the speakers being oriented in a vertical line on the speaker mount and the sonic axes splayed. As set forth further below, a control signal is used to determine the desired direction of the audio at any given time. FIG. 5 shows that the speaker mount 302 may be coupled to a gimbal 500 for rotating the speaker mount 302 about the vertical axis, as indicated by the arrows 502. The control signal contains an azimuthal component that is used to actuate the gimbal 500 to establish the angular position of the line of speakers 304 as demanded by the azimuthal component of the control signal. The control signal may also include an elevational component, and at least one speaker 304 is actuated based on the sonic axis of the speaker satisfying the elevational component to emit demanded sound along its respective sonic axis, it may now be understood that the gimbal 500 and/or speaker assembly 300 may contain one or more processors accessing one or more computer memories such as any of the processors and memories described herein to respond to the control signal.

It may now be divulged that present principles recognize that humans typically can sense the direction of sound better in the azimuthal plane than in the elevational plane. For this reason, the assembly 300 may limit elevational selections to several discrete steps, which is determined by the number of speakers. However, in the azimuthal dimension, a single axis gimbal 500 provides a much higher granularity of the sound direction, simplifying design and reducing cost.

In the example system of FIG. 3, the control signal may come from a game console implementing some or all of the components of the CE device 44, or from a camera such as one of the cameras discussed herein, and the gimbal assembly may include, in addition to the described mechanical parts, one or more the components of the second CE device 46. The game console may output video on the AVDD. Two or more of the components of the system may be consolidated into a single unit.

Note that the sound beam from each ultrasonic speaker 304 is typically confined to relatively narrow cone defining a cone angle about the sonic axis 306 typically of a few degrees up to, e.g., thirty degrees. Thus, each speaker 304 is a directional sound source that produces a narrow beam of sound by modulating an audio signal onto one or more ultrasonic carrier frequencies. The highly directional nature of the ultrasonic speaker allows the targeted listener to hear the sound clearly, while another listener in the same area, but outside of the beam hears very little of the sound.

As mentioned above, a control signal for actuating the gimbal 500 to move the speaker mount 302 may be generated by, in examples, one or more control signal sources 308 such as cameras, game consoles, personal computers, and video players in, e.g., a home entertainment system that output related video on a video display device. By this means, sound effects such as a vehicle (plane, helicopter, car) moving through a space can be achieved with a great degree of accuracy using only a single speaker as a sound source.

In an example, the control signal source such as a game controller may output the main audio on a main, non-ultrasonic speaker(s) of, e.g., a video display device such as a TV or PC or associated home sound system that the game is being presented on. A separate sound effect audio channel may be included in the game, and this second sound effect audio channel is provided to the US speakers 304 along with or as part of the control signal sent to move the gimbal 500, for playing the sound effect channel on at least one of the directional US speakers 304 while the main audio of the game is simultaneously played on the non-US speaker(s).

The control signal source may receive user input from one or more remote controllers (RC) such as computer game RCs. The RC and/or sound headphone provided for each game player for playing the main (non-US) audio may have a locator tag appended to it such as an ultra-wide band (UWB) tag by which the location of the RC and/or headphones can be determined. In this way, since the game software knows which headphones/RC each player has, it can know the location of that player to aim the US speaker at for playing US audio effects intended for that player.

Instead of UWB, other sensing technology that can be used with triangulation to determine the location of the RC may be used, e.g., accurate Bluetooth or WiFi or even a separate GPS receiver. When imaging is to be used to determine the location of the user/RC and/or room dimensions as described further below, the control signal source may include a locator such as a camera (e.g., a CCD) or a forward looking infrared (FLIR) imager.

User location may be determined during an initial auto calibration process. Another example of such a process is as follows. The microphone in the head set of the game player can be used or alternatively a microphone incorporated into the ear pieces of the headset or the earpiece itself could be used as a microphone. The system can precisely calibrate the location of each ear by moving the US beam around until a listener wearing the headphones indicates, e.g., using a predetermined gesture, which ear is picking up the narrow US beam.

In addition or alternatively the gimbal assembly may be coupled to a camera or FLIR imager which sends signals to one or more processors accessing one or more computer memories in the gimbal 500. The control signal (along with, if desired, the sound effect audio channel) is also received (typically through a network interface) by the processor. The gimbal 500 rotates the speaker mount 302 in the azimuthal dimension as demanded by the control signal.

As stated above, to account for a demanded elevation angle of sound in the control signal, the speaker 304 whose sonic axis 306 most closely aligns with the demanded elevation angle is activated to emit the demanded sound. All other speakers in the assembly may remain deactive, or when multiple elevation angles are demanded, plural speakers whose sonic axes most closely satisfy the demanded elevation angles are activated.

Turning to FIG. 6 for a first example, a computer game designer may designate an audio effects channel in addition to a main audio channel which is received at block 600 to specify a location (azimuth and, if desired, elevation angle) of the audio effects carried in the audio effects channel and received at block 602. This channel typically is included in the game software (or audio-video movie, etc.). When the control signal for the audio effects is from a computer game software, user input to alter motion of an object represented by the audio effects during the game (position, orientation) may be received from a RC at block 604. At block 606 the game software generates and outputs a vector (x-y-z) defining the position of the effect-over time (motion) within the environment. This vector is sent to the gimbal 500 at block 608 such that the ultrasonic speaker(s) 304 plays back the audio effect channel audio.

FIG. 7 illustrates what the speaker assembly 300 does with the control signal. At block 700 the audio channel with directional vector(s) is received. Proceeding to block 702, the gimbal 500 is actuated to rotate the speaker mount 302 to align the speakers 304 with the demanded azimuthal component of the vector in the control signal. At block 704, the demanded audio is played on the speaker 306 whose sonic axis is oriented in the elevational dimension at an angle that most closely satisfies the elevational component of the vector in the control signal, confined within the cone angle of the selected speaker.

Figure 8:
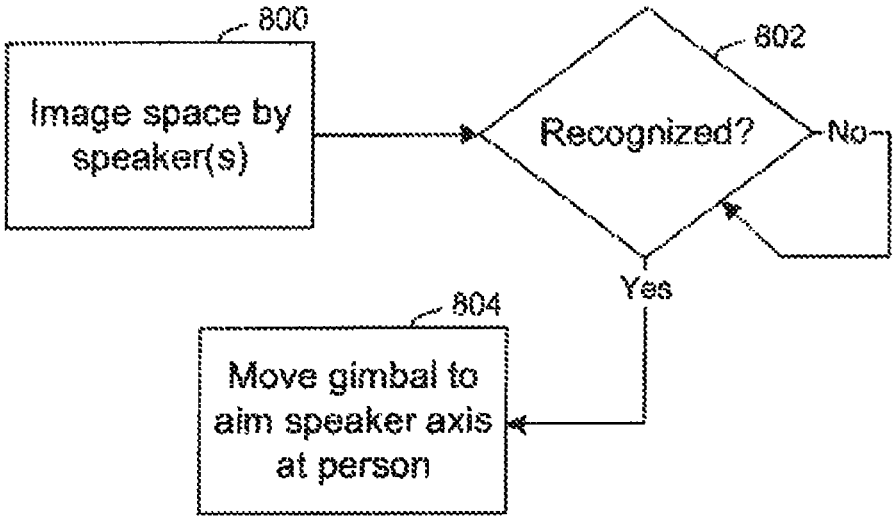
FIG. 8 is a flow chart of example alternate logic for directing the sonic beam toward a particular viewer.

As alluded to above, a camera such as the one shown in FIG. 1 may be used to image a space in which the speaker assembly 300 is located at block 800 of FIG. 8. While the camera in FIG. 1 is shown coupled to an audio video display device, it may alternatively be the locator provided on the game console serving as the control signal generator or the imager on the speaker assembly itself. In any case, it is determined at decision diamond 802, using face recognition software operating on a visible image from, e.g., the locator or imager, whether a predetermined person is in the space by, e.g., matching an image of the person against a stored template image, or by determining, when FLIR is used, whether an IR signature matching a predetermined template has been received. If a predetermined person is imaged, the speaker assembly may be moved at block 804 to aim the sonic axes 306 at the recognized speaker.

To know where the imaged face of the predetermined person is, one of several approaches may be employed. A first approach is to instruct the person using an audio or video prompt to make a gesture such as a thumbs up or to hold up the RC in a predetermined position when the person hears audio, and then move the gimbal assembly to sweep the sonic axis around the room until the camera images the person making the gesture. Another approach is to preprogram the orientation of the camera axis into the gimbal assembly so that the gimbal assembly, knowing the central camera axis, can determine any offset from the axis at which the face is imaged and match the speaker orientation to that offset. Still further, the camera itself may be mounted on the gimbal assembly in a fixed relationship with the sonic axis 306 of a speaker 304, so that the camera axis and sonic axis always match. The signal from the camera can be used to center the camera axis (and hence sonic axis) on the imaged face of the predetermined person.

Figure 9:
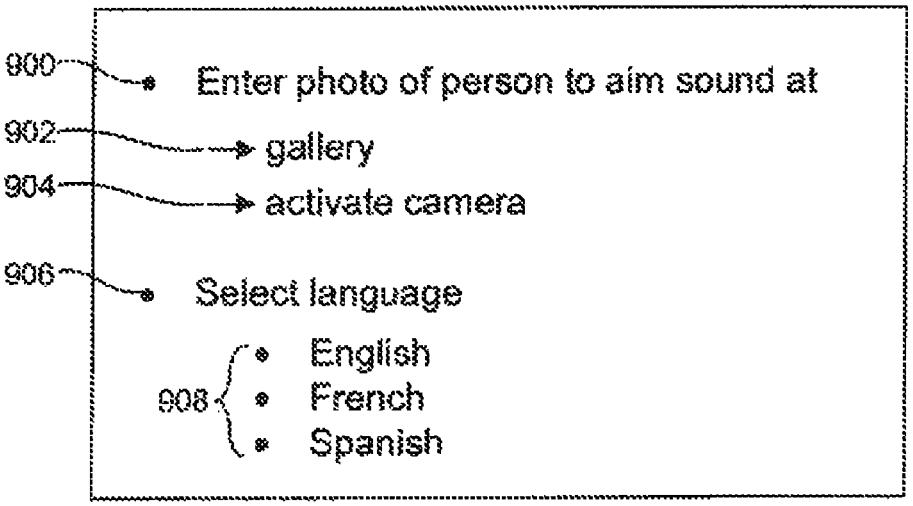
FIG. 9 is an example screen shot for inputting a template for the logic of FIG. 8 to employ.

FIG. 9 presents an example user interface (UI) that may be used to eater the template used at decision diamond 802 in FIG. 8. A prompt 900 can be presented on a display such as a video display to which a game controller is coupled for a person to enter a photo of a person at whom the some axis should be aimed. For instance, a person with sight and/or hearing disabilities may be designated as the person at whom to aim the speaker assembly 300.

The user may be given an option 902 to enter a photo in a gallery, or an option 904 to cause the camera to image a person currently in front of the camera. Other example means for entering the test template for FIG. 8 may be used. For example, the system may be notified by direct user input where to aim the sonic axes 306.

In any case, it may be understood that principles may be used to deliver video description audio service to a specific location where the person who has a visual disability may be seated.

Another characteristic of the ultrasonic speaker is that if aimed at a reflective surface such as a wall, the sound appears to come from the location of the reflection. This characteristic may be used as input to the gimbal assembly to control the direction of the sound using an appropriate angle of incidence off the room boundary to target the reflected sound at the user. Range finding technology may be used to map the boundaries of the space. Being able to determine objects in the room, such as curtains, furniture, etc. would aid in the accuracy of the system. The addition of a camera, used to map or otherwise analyze the space in which the effects speaker resides can be used to modify the control signal in a way that improves the accuracy of the effects by taking the environment into account.

With greater specificity, the room may be imaged by any of the cameras above and image recognition implemented to determine where the walls and ceiling are. Image recognition can also indicate whether a surface is a good reflector, e.g., a flat white surface typically is a wall that reflects well, while a folded surface may indicate a relatively non-reflective curtain. A default room configuration (and if desired default locations assumed for the listener(s)) may be provided and modified using the image recognition technology.

Alternatively, the directional sound from the US speaker 304 may be used by moving the gimbal assembly, emitting chirps at each of various gimbal assembly orientations, and timing reception of the chirps, to know (1) the distance to the reflective surface in that direction and (2) based on the amplitude of the return chirp, whether the surface is a good or poor reflector. Yet again, white noise may be generated as a pseudorandom (PN) sequence and emitted by the US speaker and reflections then measured to determine the transfer function of US waves for each direction in which the "test" white noise is emitted. Yet further, the user may be prompted through a series of UIs to enter room dimensions and surface types.

Still again, one or more of the room dimension mapping techniques described in USPP 2015/0256954, incorporated herein, by reference, may be used.

Or, structured light could be employed to map a room in 3D for more accuracy. Another way to check the room, is the use an optical pointer (known divergence), and with a camera, it can accurately measure the room dimensions. By the spot dimensions, and distortions, the angle of incidence on a surface can be estimated. Also the reflectivity of the surface is an additional hint as to whether it may or may not be a reflective surface for sound.

In my case, once the room dimensions and surface types are known, the processor of the gimbal assembly, knowing, from the control signal, the location at which audio effects are modeled to come and/or be delivered to, can through triangulation determine a reflection location at which to aim the US speakers so that the reflected sound from the reflection location is received at the intended location in the room. In this manner the US speakers may not be aimed directly at the intended player but instead may be aimed at the reflection point, to give the intended player the perception that the sound is coming from the reflection point and not the direction of the US speaker.

FIG. 9 illustrates a further application, in which multiple ultrasonic speakers on one or more gimbal assemblies provide the same audio but in respective different language audio tracks such as English and French simultaneously as the audio is targeted. A prompt 906 can be provided to select the language for the person whose facial image establishes the entered template. The language may be selected from a list 908 of languages and correlated to the person's template image, such that during subsequent operation, when a predetermined face is recognized at decision diamond 802 in FIG. 8, the system knows which language should be directed to each user. Note that while the gimbal-mounted ultrasonic speaker assembly precludes the need for phased array technology, such technology may be combined with present principles.

Instead of using image recognition to target a specific language at a specific user, face recognition can be used to identify a hearing-disabled person for accessibility. That is, a different audio content can be targeted to a specific user via facial recognition for accessibility reasons.

The above methods may be implemented as software instructions executed by a processor, including suitably configured application specific integrated circuits (ASIC) or field programmable gate array (FPGA) modules, or any other convenient manner as would be appreciated by those skilled in those art. Where employed, the software instructions may be embodied in a device such as a CD Rom or Flash drive or any of the above non-limiting examples of computer memories that are not transitory signals. The software code instructions may alternatively be embodied in a transitory arrangement such as a radio or optical signal, or via a download over the internet.

It will be appreciated that whilst present principals have been described with reference to some example embodiments, these are not intended to be limiting, and that various alternative arrangements may be used to implement the subject matter claimed herein.

What is claimed is:

1. An apparatus, comprising:

at least one speaker mount;

plural ultrasonic speakers arranged on the speaker mount and spaced vertically from each other, each ultrasonic speaker being configured to emit sound along a respective sonic axis;

a gimbal assembly coupled to the speaker mount;

at least one computer memory that is not a transitory signal and that comprises instructions executable by at least one processor to:

receive a control signal representing motion of an object in a computer simulation; and responsive to the control signal, actuate the gimbal assembly to move the plural ultrasonic speakers such that the sound axes move azimuthally.

2. The apparatus of claim 1, comprising the processor.

3. The apparatus of claim 1, wherein the instructions are executable to:

responsive to the control signal, actuate a first speaker on the speaker mount responsive to a determination that a sonic axis of the first speaker satisfies the control signal more closely than the sonic axes of speakers other than the first speaker.

4. The apparatus of claim 1, wherein the control signal is received from a computer game console outputting a main audio channel for playing on non-ultrasonic speakers.

5. The apparatus of claim 1, wherein responsive to the control signal, the instructions are executable to move the speaker mount to direct sound to a location associated with a listener.

6. The apparatus of claim 5, wherein the instructions are executable to direct sound at a reflection location such that reflected sound arrives at the location associated with the listener.

7. The apparatus of claim 1, wherein the control signal represents at least one audio effect data in a received audio channel.

8. The apparatus of claim 1, wherein the sonic axes establish respective angles with respect to a vertical axis, the angles being different from each other.

9. A method comprising: receiving at least one control signal representing motion of an object in a computer simulation; actuating a gimbal assembly to move an ultrasonic speaker mount at least in part based on an azimuthal component of the control signal; and selecting one of plural speakers on the speaker mount to play the audio effect at least in part based on an elevational component of the control signal.

10. The method of claim 9, wherein the ultrasonic speakers are configured to emit sound along respective sonic axes, and the control signal causes the gimbal assemble to move the speaker such that the sound axis moves azimuthally.

11. The method of claim 10, wherein the sonic axes establish respective angles with respect to a vertical axis, the angles being different from each other.

12. The method of claim 9, comprising moving the speaker to direct sound to a location associated with a listener.

13. The method of claim 9, wherein the audio effect is established at least in part from input to a computer game input device.

14. Device comprising:

at least one computer memory that is not a transitory signal and that comprises instructions executable by at least one processor to:

receive a control signal that is based at least in part on motion of an object in a computer game;

responsive to the control signal, actuate a gimbal assembly to move an ultrasonic speaker assembly azimuthally; and responsive to the control signal, select for play of demanded audio one of plural speakers on the speaker assembly.

15. The device of claim 14, comprising the processor.

16. The device of claim 14, wherein the ultrasonic speakers are configured to emit sound along respective sonic axes, wherein the sonic axes establish respective angles with respect to a vertical axis, the angles being different from each other.

17. The device of claim 14, wherein responsive to the control signal, the instructions are executable to move the speaker mount to direct sound to a location associated with a listener.

18. The device of claim 14, wherein the control signal represents at least one audio effect data in a received audio channel from a source also outputting a main audio channel for playing on non-ultrasonic speakers.

19. The device of claim 18, wherein the audio effect data is established at least in part from input to a computer game input device outputting a main audio channel for playing on non-ultrasonic speakers.

20. The device of claim 17, wherein the instructions are executable to determine the location associated with a listener using headphones associated with a game console.

* * * * *